US008932019B2

(12) United States Patent
Bohl et al.

(10) Patent No.: US 8,932,019 B2
(45) Date of Patent: Jan. 13, 2015

(54) RADIAL OR DIAGONAL FAN WHEEL

(75) Inventors: Katrin Bohl, Künzelsau (DE); Marc Schneider, Dörzbach (DE); Jürgen Schöne, Bad Mergentheim (DE)

(73) Assignee: EMB-PAPST Mulfingen GmbH & Co. KG, Mulfingen (DE)

( * ) Notice: Subject to any disclaimer, the term of this patent is extended or adjusted under 35 U.S.C. 154(b) by 774 days.

(21) Appl. No.: 13/034,295

(22) Filed: Feb. 24, 2011

(65) Prior Publication Data

US 2011/0211963 A1 Sep. 1, 2011

(30) Foreign Application Priority Data

Feb. 26, 2010 (DE) ..... 10 2010 009 566
Feb. 4, 2011 (EP) ..... 11153316

(51) Int. Cl.
*F04D 29/28* (2006.01)
*F04D 29/16* (2006.01)
(Continued)

(52) U.S. Cl.
CPC ..... *F04D 29/162* (2013.01); *F04D 29/281* (2013.01); *F04D 29/661* (2013.01); *F04D 29/681* (2013.01); *Y10S 416/50* (2013.01)
USPC ..... 416/182; 416/185; 416/186 R; 416/192; 416/223 B; 416/500; 415/119

(58) Field of Classification Search
CPC ... F04D 29/162; F04D 29/281; F04D 29/661; F04D 29/681
USPC ..... 416/182, 185, 186 R, 190, 192, 223 B, 416/500; 415/119
See application file for complete search history.

(56) References Cited

U.S. PATENT DOCUMENTS 2,724,544 A 5/1951 Hardigg
4,874,293 A 10/1989 Gutzwiller
(Continued)

FOREIGN PATENT DOCUMENTS

DE 2 165 610 7/1973
DE 2940773 C2 10/1979
(Continued)

OTHER PUBLICATIONS

Catalog—Kunststofftechnik KG—Trilingual—KT Heavy Duty Thermoplastik Radial Fans—Jan. 2011.
(Continued)

*Primary Examiner* — Igor Kershteyn
(74) *Attorney, Agent, or Firm* — Brinks, Gilson & Lione

(57) ABSTRACT

A fan wheel (1) is designed as a radial or diagonal fan, comprising a top plate (2) with an inlet port (4), a base plate (6) and a plurality of fan blades (8) distributed around the inlet port (4) and around an axis of rotation (Z). Blade ducts extend (10) respectively between the adjacent fan blades (8). The blade ducts lead radially or diagonally outward from the area of the inlet port (4) and form blow-out ports in the outer region. The blade ducts (10) are designed, with respect to their effective flow cross-section, as large enough that during operation, a turbulent flow with a Reynolds number markedly greater than 2300 is achieved. The top plate (2) or the base plate (6) or both feature a rotationally asymmetrical geometry with a continuous profile, at least in angular sections encompassing the fan blades (8).

13 Claims, 5 Drawing Sheets

(51) Int. Cl.
*F04D 29/66* (2006.01)
*F04D 29/68* (2006.01)

(56) References Cited

U.S. PATENT DOCUMENTS

| | | | | |
|---|---|---|---|---|
| 6,299,409 | B1 * | 10/2001 | Matsunaga et al. | 415/206 |
| 7,455,504 | B2 | 11/2008 | Hill et al. | |
| 2007/0116561 | A1 | 5/2007 | Hill et al. | |
| 2009/0255654 | A1 * | 10/2009 | Zheng et al. | 415/119 |

FOREIGN PATENT DOCUMENTS

| | | | |
|---|---|---|---|
| DE | 3247453 | C1 | 12/1982 |
| DE | 19918085 | A1 | 4/1999 |
| DE | 20303443 | U1 | 3/2003 |
| DE | 603 11 165 | T2 | 1/2008 |
| EP | 1032766 | B1 | 3/2002 |
| EP | 1411248 | A1 | 6/2002 |
| EP | 1 348 871 | B1 | 1/2007 |
| EP | 1933039 | A1 | 6/2008 |
| EP | 1574716 | B1 | 8/2008 |
| GB | 438036 | A1 | 5/1934 |
| JP | 60-113095 | | 6/1985 |
| JP | 60113095 | A | 6/1985 |
| JP | 2001-173595 | | 6/2001 |
| JP | 2001263294 | A | 9/2001 |
| JP | 2008-223741 | A | 9/2008 |

OTHER PUBLICATIONS

Price List Kunststofftechnik KG—Apr. 1977.

* cited by examiner

Fig.1
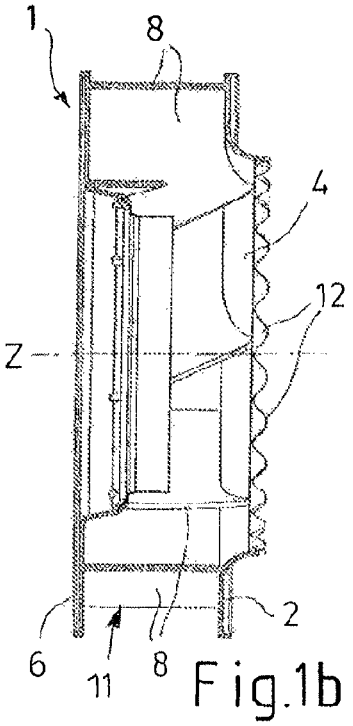
Fig.1b
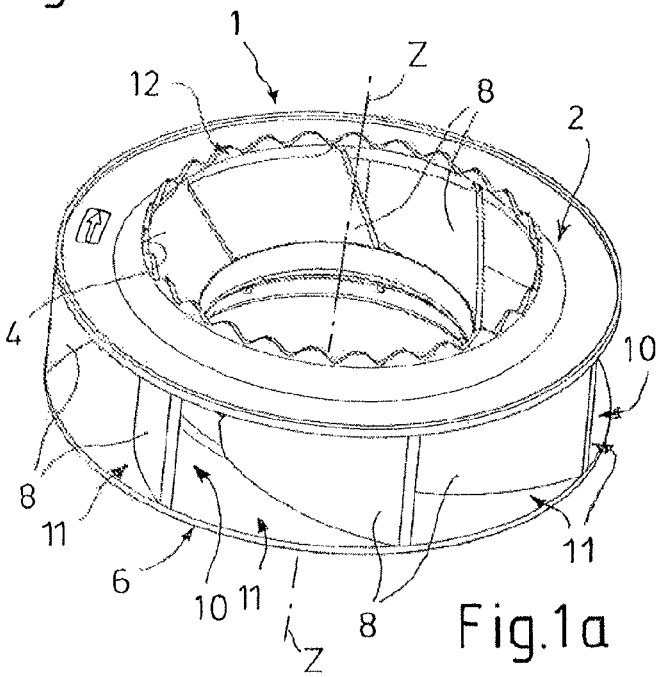
Fig.1a
Fig.2
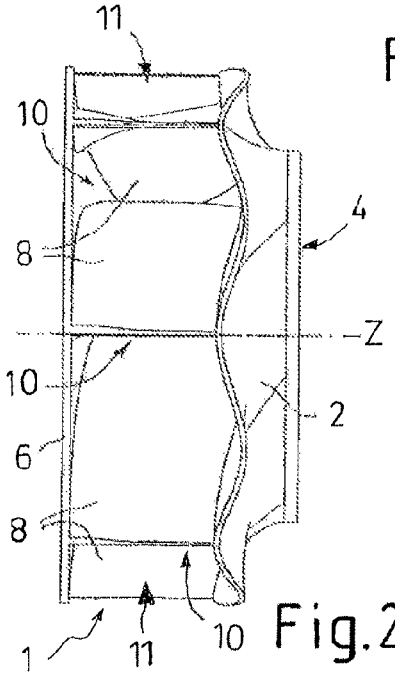
Fig.2b
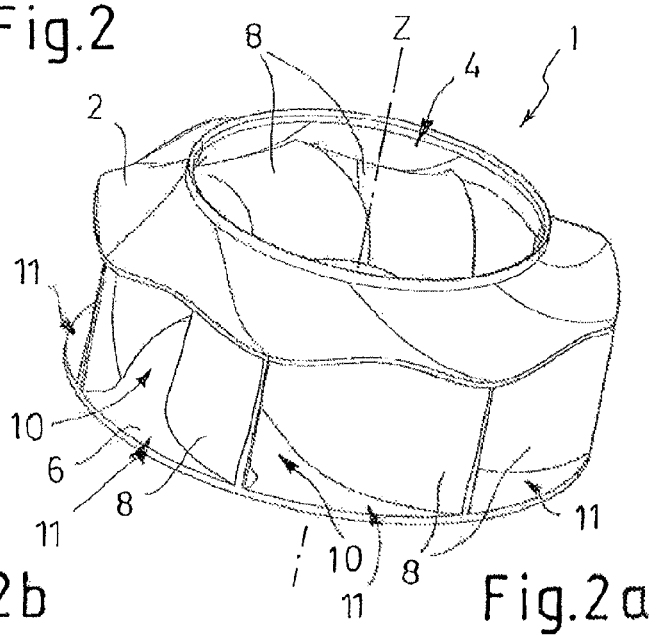
Fig.2a

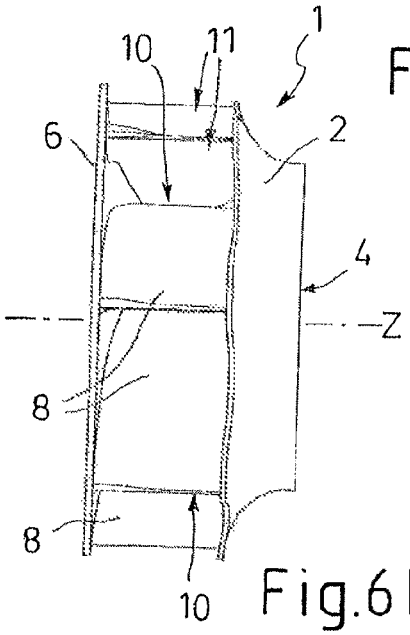
Fig.6b
Fig.6
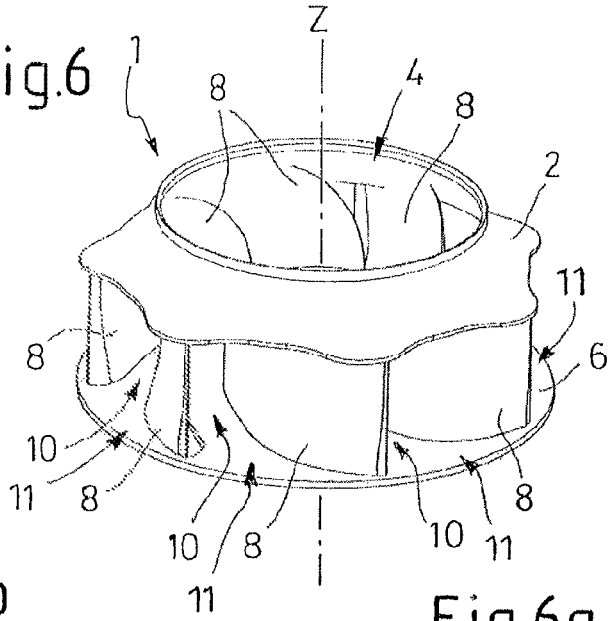
Fig.6a
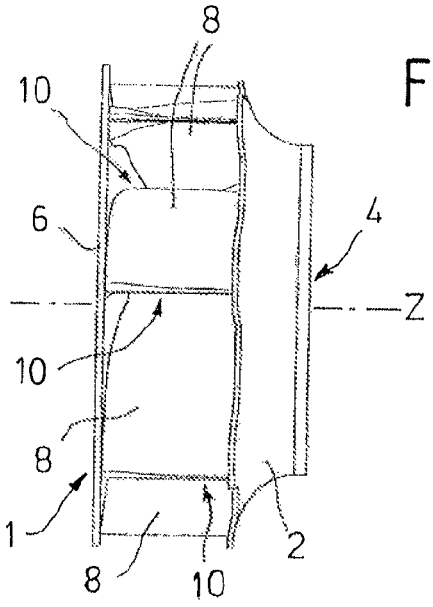
Fig.7b
Fig.7
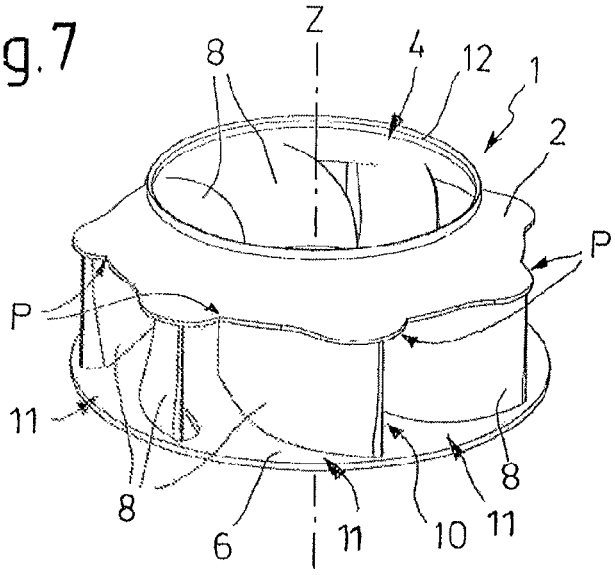
Fig.7a

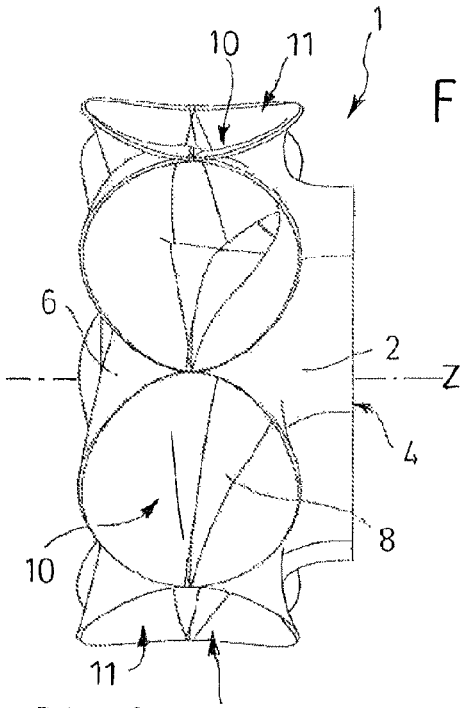
Fig.8b
Fig.8
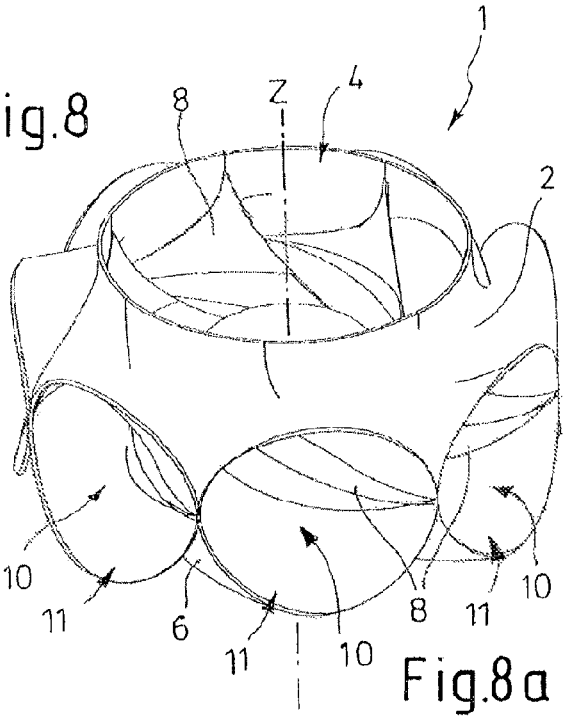
Fig.8a
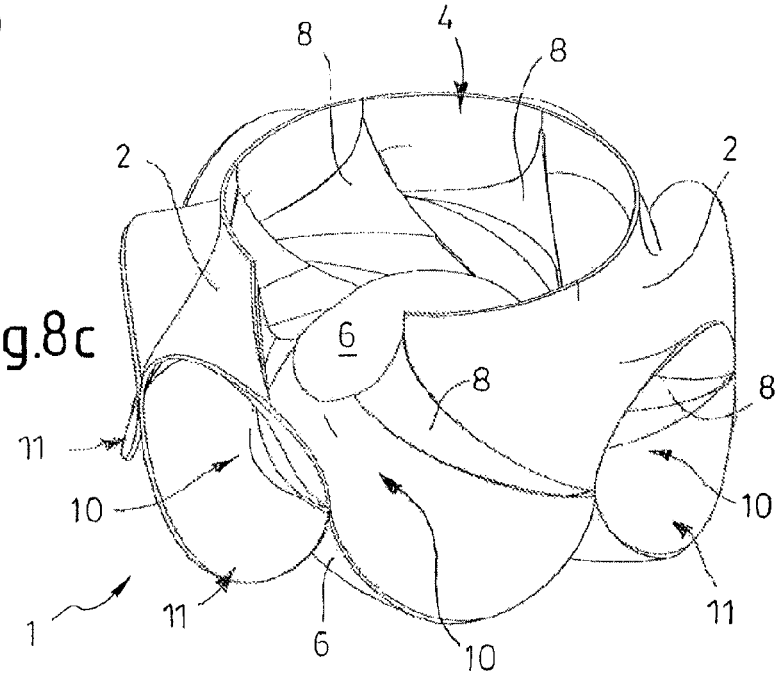
Fig.8c

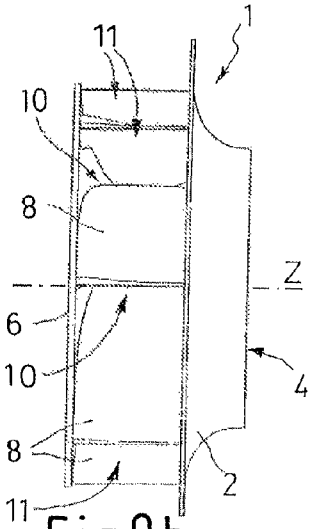
Fig.9b
Fig.9
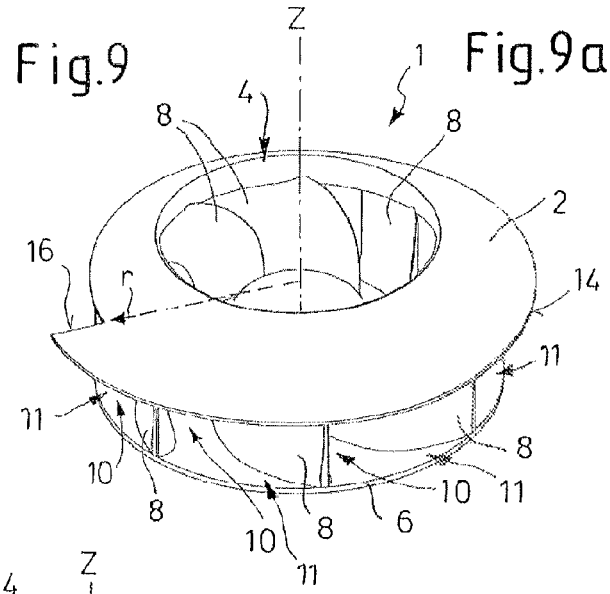
Fig.9a
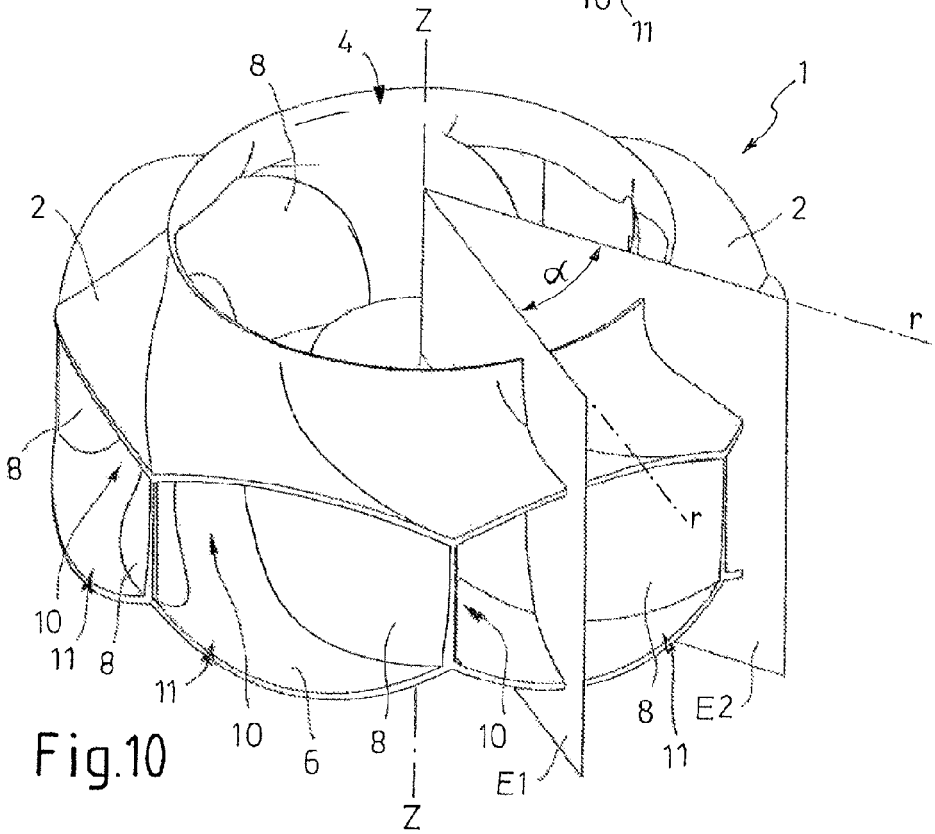
Fig.10

RADIAL OR DIAGONAL FAN WHEEL

CROSS REFERENCE TO RELATED APPLICATION

This application claims priority to German Patent Application 102010009566.4, filed Feb. 26, 2010 and European Patent Application No. 11153316.2, filed Feb. 4, 2010, which are herewith incorporated by reference in their entirety.

BACKGROUND OF THE INVENTION

The invention relates to a fan wheel designed as a radial or diagonal fan, comprising a top plate with an inlet port, a base plate, and a plurality of fan blades distributed around the inlet port and around an axis of rotation, as well as blade ducts formed respectively between the adjacent fan blades in a circumferential direction, said fan blades leading radially or diagonally outward from the area of the inlet port and forming blow-out ports in the external region, the blade ducts being designed, with respect to their effective flow cross-section, as large enough that during operation, a turbulent flow with a Reynolds number markedly greater than 2300 is achieved, the top plate and/or the base plate displaying a rotationally asymmetrical geometry.

Fan wheels of his kind are termed turbo-machines (turbofans). They are characterized by the very high Reynolds number Re, which, with a value of at least 5000 (i.e. Re≥5000) is significantly greater by a factor of >2 than the sufficiently well known threshold value of approximately 2300 between laminar flow (Re<2300) and turbulent flow (Re>2300). In most cases, however, Re is actually ≥10000 (factor>4) and can go up to several 10000 (for example 35000). Due to the turbulent flow in the blade ducts, high efficiency is achieved in the region above 0.6, and up to at least 0.8 (60-80%). It can be presumed that that the flow through the flow ducts is predominantly a so-called tubular flow so that the Reynolds number Re can be calculated based on the characteristic quantities for a tubular flow, i.e. the flow width, which is typically an idealized substitute inner diameter d, the value of the flow velocity $v_m$ averaged over the cross section, and the (kinetic) viscosity ν of the respective medium. The dimensionless Reynolds number is then:

$$Re = \frac{v_m \cdot d}{\nu}$$

In the equation above, it is assumed that air has a kinetic viscosity of $\nu=1.5\cdot10^{-5}$ m²/s.

Efficiency is defined as the ratio of utilized output power to supplied input power. For an electric motor drive, the electric input power or a mechanical shaft drive power used to rotate the fan can be applied as input power. In this case, the so-called "free-flowing efficiency" $\eta_{ff}$ is defined as:

$$\eta_{ff} = \frac{\dot{V} \cdot \Delta p_{ff}}{P_w}$$

$\eta_{ff}$ is the ratio of the product of volume flow $\dot{V}$ multiplied by pressure difference $\Delta\rho_{ff}$ to input power $P_w$. The relevant values are measured according to ISO 5801.

Furthermore, in connection with the invention, the term "rotationally asymmetrical" means that any two different radial cross sections through the base plate and/or the top plate in two planes that contain the rotational axis and include a specific differential angle in the circumferential direction are not congruent when there are different circumferential angles, but rather deviate from one another. In this case, a deviation could in principle be present in the direction of the axis of rotation (axially) and/or in the radial direction (radially). In other words, this means that in the case of a rotational asymmetry, a rotation of the body through specific angles around the axis of rotation does not map the object or its sectional plane on itself.

A fan wheel is described in various versions in the publication JP 2001-263 294. In this case, the top plate or the base plate, or each of the two, has a contour that is stepped obliquely in the circumferential direction. This step shape, which is oblique in the direction of rotation, is meant to reduce a tendency of the airflow to break away, and in this way to have a positive influence on noise and efficiency. The step shape results in each fan blade having different outlet widths (measured axially) on its suction side and its pressure side, which means, depending on the embodiment, that the outlet width on the suction side can be smaller or greater than the outlet width on the pressure side.

EP 1 933 039 A1 describes a radial fan with ribs, recesses or as the case may be, indentations on the outside of the top plate. This configuration is intended to reduce noise as a result of specific flow routing.

The additional publication, EP 1 032 766 B1, describes a fan wheel, in particular, as a turbocharger. In this fan wheel, blades are formed by embossings on at least one of the two plates (base plate and/or top plate). These embossings also produce a rotationally asymmetrical geometry. However, this publication is not concerned with exerting an influence on flow; it is chiefly concerned with aspects of the manufacturing process and the factors that promote stability.

A rotationally asymmetrical geometry is also produced according to the publication DE 32 47 453 C1, by means of cupping. Blade parts herein are molded from a base plate and an annular disk opposite to it after heating said blade parts, and are then fitted together to form a fan impeller by welding together the respective crest sections of the blade parts. However, as in the case of EP 1032 766 B1 cited above, this publication is not concerned with influencing flow. Its sole purpose is to simplify the production of a fan impeller from thermoplastic plastic and to increase the impeller's stability.

The publication US 2007/01 16561 A1, or as the case may be the corresponding U.S. Pat. No. 7,455,504 B2 describes different embodiments of a quite special flow machine that is intended, in very small embodiments, for use in computers. Here, the flow ducts are designed with a very small flow cross-section in order to achieve a laminar flow. Consequently, this is not a "turbo-machine" in the sense of the invention; because in that prior art, the specific intention is that the Reynolds number be less than 2300. In concrete terms, the entire flow cross-section is divided into a plurality of small flow ducts. This is achieved, for example, by means of a honeycomb-like structure, which also appears to produce a rotationally asymmetrical design. However, this is done only to avoid forming any flow ducts, in order to ensure laminar flows. Features of these known embodiments cannot be applied to a "turbo-machine" of the type described in the present invention, because they involve completely different operating principles. For example, the peak efficiency of the known "laminar machine" is only around 0.2 (20%).

Numerous further publications describe rotationally symmetrical fan wheels. The following publications can be mentioned solely as examples: DE29 40 773 C2, DE199 18 085 A1, EP 1 574 716 B1, and DE203 03 443 U1, as well as GB 438 036A1. Such fans, with rotationally symmetrically designed base plates and/or top plates display in part, both in the direction of the axis of rotation and in a circumferential direction, highly irregular velocity and pressure distributions, i.e. locally elevated velocity/pressure ranges. This can result in flow breakaway and even backflow, which in turn cause aerodynamic losses, efficiency losses, and increased noise emission. Regarding the cited document GB 438 036 A, it should also be mentioned that each fan blade and/or each top plate is meant to be comprised of two separate layers that are connected in a way similar to corrugated cardboard via wavy connecting webs. This results in a rotationally asymmetrical profile between the two layers, however the surfaces of the top plates, which are responsible for the flow properties, are nevertheless rotationally symmetrical. There is no flow through the hollow space between the layers which is reinforced with "corrugated cardboard."

SUMMARY OF THE INVENTION

The present invention is based on the problem of providing a fan wheel of the type described in the introduction, by means of which, along with good mechanical stability, there will be improved influence on flow in order to optimize air output and efficiency and achieve better noise levels.

A first aspect of the invention provides that, between two radial sections containing the axis of rotation and being located on either side of a given fan blade, the rotationally asymmetrical top plate or base plate, respectively, is designed with a continuous contour across the fan blade. This is advantageous in solving the basic problem of reducing noise.

In addition, another aspect of the invention is that the respective rotationally asymmetrical top plate or base plate, with respect to its deviations in axial direction, also has a continuous profile on its respective outside surface, which is the bottom surface of the base plate or the top surface of the top plate, along the entire circumference (across the blade regions as well). In mathematical terms, this means that there is a critical angle $\alpha G>0°$ between two radial sections that run through the axis, beyond which angle further convergence of the two radial sections results in the axial shape-deviations of the outside surfaces to become smaller. There is thus a continuous shape of the profile, by means of which marked improvement is achieved, in contrast to the stepped shape according to JP 2001-263 294, for example, and also according to EP 1 933 039 A1.

In a further embodiment of the invention, the geometrical deviations of two different sections containing the axis of rotation of the respective, rotationally asymmetrical plate (top plate or base plate) can be arbitrary in a radial direction (in contrast to the inventive shape, which is in any case continuous in an axial direction). This means that radially, a continuous or an abrupt contour is optionally possible.

The velocity and pressure distribution in the direction of the axis of rotation can be influenced by means of the geometric configuration of the fan blades and the configuration of the flow ducts formed between the blades by means of a known, rotationally symmetrically designed base plate and/or top plate. But an air flow irregularity in the circumferential direction remains largely unaffected by this measure. In contrast, by means of the inventive, rotationally asymmetrical configuration, an advantageous effect can also be exerted in a controlled manner on the circumferentially occurring irregularity of the velocity and pressure distribution. This results in the following advantages, among other things:

Influence on the outflow from the fan wheel toward equalization of the flow, above all in a circumferential direction results in a reduction in the maximum local flow velocity, which has a positive effect on the aerodynamic and acoustic properties of the fan wheel. This leads to greater efficiency and reduces noise emission.

Direct influence on the flow in the fan wheel results in reduced interaction with the blade-duct walls, reduced noise, and improved air output and efficiency.

Greater latitude to influence flow (above all in a circumferential direction) and flow routing results in stabilization of flow in the blade duct and thus reduces the tendency toward flow breakaway.

Improved mechanical stability presents an opportunity to save material.

BRIEF DESCRIPTION OF THE DRAWINGS

The invention will now be explained in greater detail on the basis of several exemplary embodiments illustrated in the drawing. The following is shown:

FIG. 1 shows a first embodiment of the inventive fan wheel, specifically, in FIG. 1 *a*, a perspective view and, in FIG. 1 *b*, an axial section in a diametrical sectional plane, FIGS. 2-9 each show an additional, different design of the fan wheel is illustrated, where partial Figure a shows a perspective view and a partial Figure b shows a side view, and FIG. 10 shows an additional perspective view of the fan wheel of FIG. 4 for further illustration.

DETAILED DESCRIPTION OF THE DRAWINGS

Figure 3B:
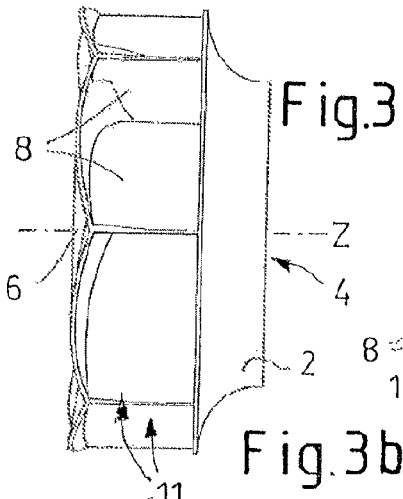

In all of the exemplary embodiments, an inventive fan wheel 1, driven in rotation around an axis of rotation Z, consists of a top plate 2, preferably with an essentially centric inlet port 4 for the inflow of air, a base plate 6 that lies opposite to it in an axial direction Z, and a plurality of fan blades 8. These fan blades 8 are arranged between the base plate 6 and the top plate 2, or are formed completely or in regions by a specific shaping of the base plate 6 and/or of the top plate 2 (cf. FIG. 8), and the plates 2, 6 then being connected directly to one another in these regions. The fan blades 8 are arranged in a specific circumferential distribution around the axis of rotation Z and the inlet port 4. Formed in the circumferential direction in each case between two adjacent fan blades 8 are blade ducts 10 which lead radially or diagonally outward from the region of the inlet port 4 and form blow-out ports on the outer region of the fan wheel 1.

As explained above, it is provided, in a manner typical of "turbo-fans," that the blade ducts 10, with respect to their effective flow cross-section, are designed as large enough that during operation, a turbulent flow with a Reynolds number Re>>2300 with high efficiency is attained between 0.6 and 1.0. In addition, the inlet port 4 has an effective suction-port flow-width DS, whose ratio to an effective flow-width DK of each blade-duct is in each case less than 10, and can in particular be even less than 3. The cited flow-widths are normally related to a circular shape, the basis for this being an idealized diameter, even if the actual flow cross-sections deviate from the circular shape.

Regarding the inventive fan wheel 1, the top plate 2, or the base plate 6, or both have a rotationally asymmetrical geometry, in order to influence flow. It is also essential that the top plate 2 and the base plate 6 not be parallel to each other.

Reference is now made to FIG. 10, which shows two additional radial planes E1 and E2, i.e. two planes running in a manner corresponding to a radius r and intersecting in the axis of rotation Z, the two planes forming a specific differential angle $\alpha$. Rotational asymmetry in the inventive sense exists when the respective cross-section of top plate 2 or of base plate 6 in plane E1 is different than the respective cross-section in plane E2, where planes E1 and E2 differ by a circumferential angle.

The invention also provides that at all radial distances from the axis of rotation the profile of the respective plate, top plate 2 or base plate 6, has no axial steps along the direction of rotation across the location of blade 8. In particular, the respective rotationally asymmetrical plate 2 or 6 has a continuous profile across its entire circumference (also across the blades) on its respective outside surface. This means that with a decreasing differential angle $\alpha$, there is a critical angle $\alpha_G>0°$, beyond which further convergence of the two planes E1 and E2 (FIG. 10) leads to a decrease in the dimensional deviations of the bottom surface of base plate 6 or the top surface of top plate 2, or both.

In contrast to continuous shape in an axial direction Z, the invention allows for arbitrary deviation in a radial direction in the geometry of two different sections containing the axis of rotation Z (radius r in FIG. 10). This enables both continuous and abrupt peripheries. Individual exemplary embodiments are briefly described in more detail below.

In the version according to FIG. 1, the top plate 2 is provided with a wheel inlet 12 in the region of the inlet port 4, the top plate 2 being designed in the region of this wheel inlet 12 as rotationally asymmetrical with respect to a rotation about the axis of rotation Z. In the example illustrated, the wheel inlet 12 extends axially, in a web-like manner, away from the top plate 2 and displays, in a circumferential direction, a wavy contour with axial elevations interspersed with depressions. The fan wheel 1 is designed here as a radial fan. Additionally or alternatively, however, the top plate 2 can also be designed in the region of the inlet port 2, or as the case may be in the region of the wheel inlet 12, as rotationally asymmetrical in a radial direction as well.

The version according to FIG. 2 is also a radial fan. Only the top plate 2 is designed as rotationally asymmetrical with respect to the axis of rotation Z. To that end, in this example, the top plate 2 has a wave-like design in the circumferential direction, with a convex, outward-curving section between any two adjacent fan blades 8. These sections merge continuously in the region of each fan blade 8.

Figure 3A:
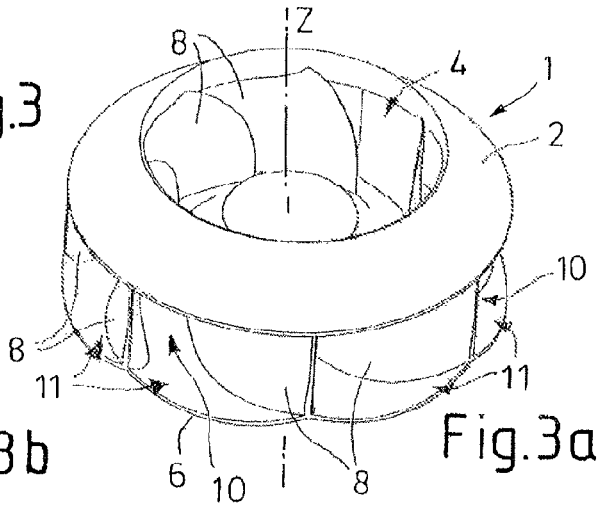

FIG. 3 illustrates a version that is designed as a radial fan, in which only the base plate 6 is designed as rotationally asymmetrical respect to the axis of rotation Z. In concrete terms, the base plate of FIG. 3 can have the same wavy design as the top plate 2 of FIG. 2.

Figure 4B:
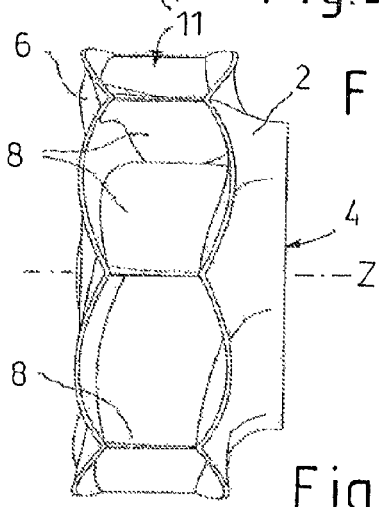
Figure 4A:
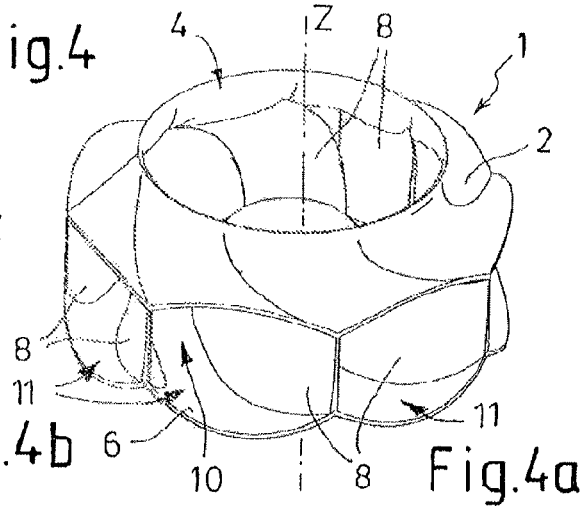

The version according to FIG. 4 actually combines the two versions of FIG. 2 and FIG. 3. This means that this radial fan is designed as rotationally asymmetrical in both the region of the top plate 2 and the region of the base plate 6.

Figure 5B:
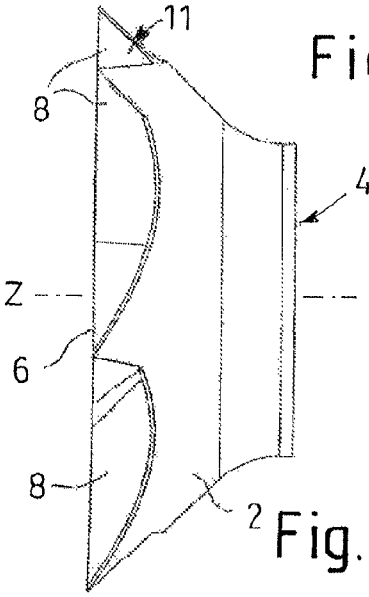
Figure 5A:
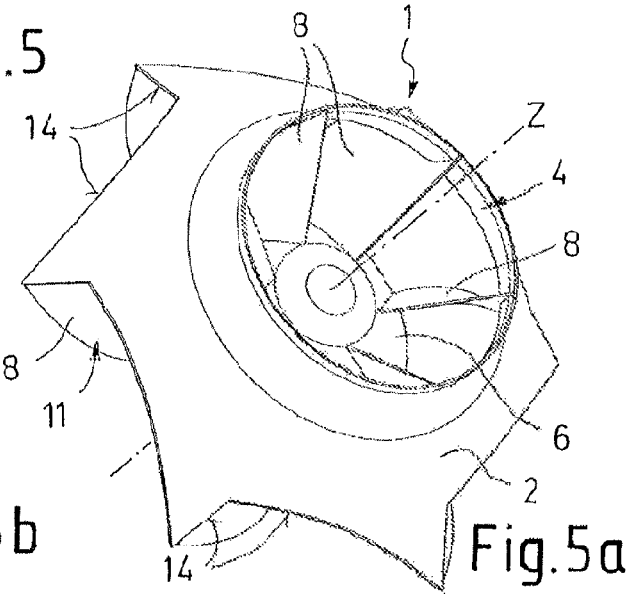

FIG. 5 illustrates a version of the fan wheel 1 as a diagonal fan, the top plate 2 being designed as rotationally asymmetrical in a radial direction r, and in this case, the changes not being continuous but abrupt. This is achieved by means of an outer circumferential edge 14 of the top plate 2 that is not continuous, but has a stepped peripheral shape with corners in the radius.

FIG. 6 illustrates a version as a radial fan in which the top plate 2 is designed rotationally asymmetrical and continuous in its radial dimensions. This means that here, the top plate 2 has a continuous periphery without steps.

The same also applies to the very similar version according to FIG. 7, in which, however, there is a corner at each of points P.

FIG. 8 shows a version as a radial fan, the two plates, both the top plate 2 and the base plate 6, rotationally asymmetrical deviations in the direction of the axis of rotation Z by means of a contour which is wave-like in a circumferential direction. In addition, the top plate 2 and the base plate 6 are directly connected in the outer circumferential region of the fan wheel 1, thereby forming together at least partial regions of the fan blades 8. For the purpose of illustration, a partial region of the top plate 2 is cut away in the area of one of the blade ducts 10 in the supplementary FIG. 8*c*. In principle, the fan blades 8 as a whole could be formed by directly connecting the correspondingly shaped base plate 6 and top plate 2 across the entire contour of the blades 8. In the version shown, however, the plates 2, 6 are connected only in the outer circumferential region, conventional blade portions being formed as separate parts in the inner inflow region of the blade ducts 10.

In all of the embodiments described above, the rotationally asymmetrical configuration produces geometric structures that are designed to recur periodically in a circumferential direction. However, the scope of the invention also includes the possibility of choosing the geometric structures in such a way that they are irregular in form or arrangement.

An exemplary embodiment of this is illustrated in FIG. 9, showing a radial fan with a rotationally asymmetrical top plate 2. The top plate has a radius r that changes abruptly at a circumferential point 16, and the outer circumferential edge 14 of the top plate 2 runs, starting at the circumferential point 16, with a continuously changing radius around the circumference, ending after 360° at a radius step at the circumferential point 16. In this example, therefore, the peripheral edge 14 takes a spiral-like course.

Other versions that result in an irregular circumferential geometry of the top plate 2 or base plate 6 are of course possible. In all embodiments, the fan blades 8 may have any desired profile. They might be curved forwards or backwards, for example, in relation to the direction of rotation. Furthermore, any combination of the individual features described above is possible.

The invention is not limited to the embodiments presented and described here; it also extends to all embodiments that operate in the inventive sense. It is expressly emphasized that the exemplary embodiments are not limited to a combination of all of the features described; each individual sub-feature may in itself have inventive significance separately from all other sub-features. Furthermore, the invention can also be defined by any other combination of specific features, or the totality of all of the individual features disclosed. This means that, in principle, virtually every individual feature could be omitted or replaced by at least one individual feature that is disclosed in another part of the application.

What is claimed is:

1. A fan wheel in the form of a radial or diagonal fan, comprising a top plate with an inlet port, a base plate, and a plurality of fan blades arranged so as to be distributed around the inlet port and around an axis of rotation, as well as blade ducts between adjacent fan blades, said blade ducts leading from an inner region proximate to the inlet port radially or diagonally outward and forming blowout-ports in an outer region, the blade ducts, with respect to their effective flow cross-section being configured large enough to achieve a turbulent flow with a Reynolds number significantly larger than 2300 during operation, wherein at least one of the top plate and base plate has a profile with a rotationally asymmetrical geometry and with axial deviations forming a continuous contour in a circumferential direction at least across each fan blade, the rotationally asymmetrical geometry has a mathematically continuous contour in a direction parallel to the axis of rotation, wherein at least one of the top plate and the base plate has a wavy configuration, wherein a convex, outward curving section is formed between two adjacent fan blades and wherein in locations of the fan blades, two respectively adjacent, outward curving convex sections form mathematically continuous transitions between each other.

2. The fan wheel of claim 1, wherein at least one of the top plate and the base plate has an outside surface with axial deviations forming a continuous contour in the circumferential direction across the entire outside surface.

3. The fan wheel of claim 1, wherein the inlet port has an effective intake opening flow width whose ratio to an effective flow width of each blade-duct is less than 10.

4. The fan wheel of claim 3, wherein the ratio of the effective intake opening flow to the effective flow width of each blade-duct is less than 3.

5. The fan wheel of claim 1, wherein the periphery of the at least one of the top plate and base plate has a continuous contour.

6. The fan wheel of claim 1, wherein the periphery of the at least one of the top plate and base plate has a discontinuous, stepped contour.

7. The fan wheel of claim 1, wherein the top plate is rotationally asymmetrical with an axially protruding wheel inlet enclosing the inlet port and having a wavy contour with alternating projections and depressions.

8. The fan wheel of claim 1, wherein the top plate has a wavy configuration.

9. The fan wheel of claim 1, wherein the base plate has a wavy configuration.

10. The fan wheel of claim 1, wherein the top plate has a rotationally asymmetrical periphery.

11. The fan wheel of claim 1, wherein the base plate has a rotationally asymmetrical periphery.

12. The fan wheel of claim 1, wherein the fan blades, at least in regions, are formed by means of a direct connection between the correspondingly shaped top plate and base plate.

13. The fan wheel of claim 1, wherein the rotationally asymmetrical geometry is configured in a recurring pattern along the circumferential direction.

* * * * *